US011879344B2

(12) United States Patent
Pendaries et al.

(10) Patent No.: US 11,879,344 B2
(45) Date of Patent: Jan. 23, 2024

(54) DEVICE FOR MAKING A FAN OR COMPRESSOR FOR THE AERONAUTICAL INDUSTRY

(71) Applicant: SAFRAN VENTILATION SYSTEMS, Blagnac (FR)

(72) Inventors: Claude Pendaries, Moissy-Cramayel (FR); François Gauharou, Moissy-Cramayel (FR)

(73) Assignee: SAFRAN VENTILATION SYSTEMS, Blagnac (FR)

( * ) Notice: Subject to any disclaimer, the term of this patent is extended or adjusted under 35 U.S.C. 154(b) by 0 days.

(21) Appl. No.: 17/741,142

(22) Filed: May 10, 2022

(65) Prior Publication Data

US 2022/0364479 A1 Nov. 17, 2022

(30) Foreign Application Priority Data

May 11, 2021 (FR) ..... 2104986

(51) Int. Cl.
*F01D 21/04* (2006.01)
*F01D 11/12* (2006.01)
*F04D 29/52* (2006.01)

(52) U.S. Cl.
CPC ..... *F01D 21/045* (2013.01); *F01D 11/125* (2013.01); *F04D 29/526* (2013.01)

(58) Field of Classification Search
CPC ..... F01D 21/045; F01D 11/12; F01D 11/122; F01D 11/125; F01D 11/127; F04D 29/526; F05D 2240/14
See application file for complete search history.

(56) References Cited

U.S. PATENT DOCUMENTS

| | | | | |
|---|---|---|---|---|
| 4,902,201 | A | 2/1990 | Neubert | |
| 5,431,532 | A | 7/1995 | Humke et al. | |
| 2011/0052383 | A1 | 3/2011 | Lussier | |
| 2012/0195746 | A1* | 8/2012 | Sarda | F04D 29/526 415/201 |
| 2017/0266893 | A1* | 9/2017 | Marin | F01D 25/24 |
| 2019/0106996 | A1 | 4/2019 | Vargas et al. | |
| 2020/0049070 | A1* | 2/2020 | Townes | F02C 9/16 |
| 2022/0268177 | A1* | 8/2022 | Richner | F01D 25/162 |

OTHER PUBLICATIONS

English machine translation of FR 2874232A1, Aug. 26, 2002.*
France Search Report dated Dec. 14, 2021, issued in Application No. FR2104986, filed May 11, 2021, 7 pages.

* cited by examiner

*Primary Examiner* — Christopher Verdier
(74) *Attorney, Agent, or Firm* — CHRISTENSEN O'CONNOR JOHNSON KINDNESS PLLC

(57) ABSTRACT

A device for making a fan or compressor for the aeronautical industry includes an annular casing with a main axis (A) and defines an internal flow duct for a gas flow along this axis. The device further includes a bladed wheel mounted inside the casing and having an axis of rotation coincident with the axis (A) of the casing. A system for retaining debris in the event of breakage of the bladed wheel has a retaining annulus mounted around the casing, which includes two radially outwardly projecting annular bosses located respectively upstream and downstream of the bladed wheel. Upstream and downstream edges of the retaining annulus are applied and attached to the bosses.

12 Claims, 8 Drawing Sheets

DEVICE FOR MAKING A FAN OR COMPRESSOR FOR THE AERONAUTICAL INDUSTRY

CROSS-REFERENCE TO RELATED APPLICATION

This application claims priority to FR 2104986, filed May 11, 2021, the disclosure of which is hereby expressly incorporated by reference herein in its entirety.

TECHNICAL FIELD

The present disclosure relates to a device for making a fan or compressor, in particular for the aeronautical industry, this device comprising in particular an annular casing and a bladed wheel mounted inside this casing.

BACKGROUND

The technical background comprises in particular the documents U.S. Pat. No. 5,431,532 A1, US 2011/0052383 A1, U.S. Pat. No. 4,902,201 A1 and US 2019/0106996 A1.

A fan or compressor for the aeronautical industry comprises an assembly comprising a casing and a bladed wheel, said assembly being referred to as a "device" in the context of the present disclosure.

FIG. 1 shows a device 10 of this type, with the casing designated by the reference 12 and the bladed wheel designated by the reference 14.

The casing 12 of this device 10 has an annular shape defining an internal flow duct of a gas flow (arrows F).

This gas flow is intended to be accelerated or compressed by the bladed wheel 14 which is mounted inside the casing 12 and which has an axis of rotation A coincident with the main axis or axis of revolution of the casing.

In some applications, the bladed wheel 14 can reach high rotational speeds, for example between 2,000 and 40,000 rpm. In the event of a mechanical problem or foreign object impact on the bladed wheel 14, this wheel can fail and the breakage of the wheel generates debris. At high speeds, this debris can pierce the casing 12. It is important to identify a solution to stop the path of this debris and avoid it reaching, for example, a passenger cabin of an aircraft equipped with the fan or the compressor.

The disclosed subject matter allows to provide a simple, effective and economical solution to this problem.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The disclosed subject matter provides a fan or compressor, in particular for the aeronautical industry, this fan or this compressor comprising a device comprising:

- an annular casing comprising a main axis and defining an internal flow duct for a gas flow along this axis,
- a bladed wheel mounted inside the casing and having an axis of rotation coincident with the axis of the casing,
- characterised in that it further comprises a system for retaining debris in the event of breakage of the bladed wheel, said system comprising a retaining annulus which is mounted around the casing, the casing comprising two radially outwardly projecting annular bosses which are located respectively upstream and downstream of the bladed wheel and to which upstream and downstream edges of the retaining annulus are applied and attached.

The debris retention system ensures that the debris generated by the breakage of the bladed wheel is prevented from leaving the device. In the event of a breakage, the debris from the wheel is likely to pass through the casing. The wheel is located between the bosses of the casing, so the debris passes through the casing between the bosses due to the centrifugal forces applied to the wheel during operation. The bosses secure the retaining annulus around the casing but also channel the debris after it passes through the casing to the retaining annulus. The debris will then reach the retaining annulus which aims to block the debris and to absorb the energy linked to the impact for example by deforming. The debris is not expelled outside the device.

The fan or compressor according to the present disclosure may comprise one or more of the following characteristics, taken alone or in combination with each other:

- the casing comprises, between the two bosses and around the bladed wheel, a tubular wall with a constant radial thickness;
- the tubular wall comprises free and bare internal and external cylindrical surfaces;
- the casing is made of metal or composite material, and/or the retaining annulus is made of metal or composite material;
- the upstream and downstream edges of the retaining annulus are bonded to the bosses;
- the retaining annulus is continuous through 360° or is formed by winding a strip of material with overlapping circumferential ends;
- the bladed wheel has an external diameter of less than or equal to 1 meter, and preferably less than or equal to 60 centimetres;
- the bosses each have an axial dimension representing between 5 and 30% of a maximum axial dimension of the bladed wheel;
- the bosses each have a radial dimension of between 200% and 1000% of a radial thickness of the casing between the bosses; and
- the retaining annulus has a radial thickness between 1 and 5 mm.

The present disclosure further relates to a fan or compressor, in particular for an aeronautical application, comprising at least one device as described above.

DESCRIPTION OF THE DRAWINGS

The foregoing aspects and many of the attendant advantages of this disclosed subject matter will become more readily appreciated as the same become better understood by reference to the following detailed description, when taken in conjunction with the accompanying drawings, wherein.

DETAILED DESCRIPTION

While illustrative embodiments have been illustrated and described, it will be appreciated that various changes can be made therein without departing from the spirit and scope of the present disclosure.

Figure 1:
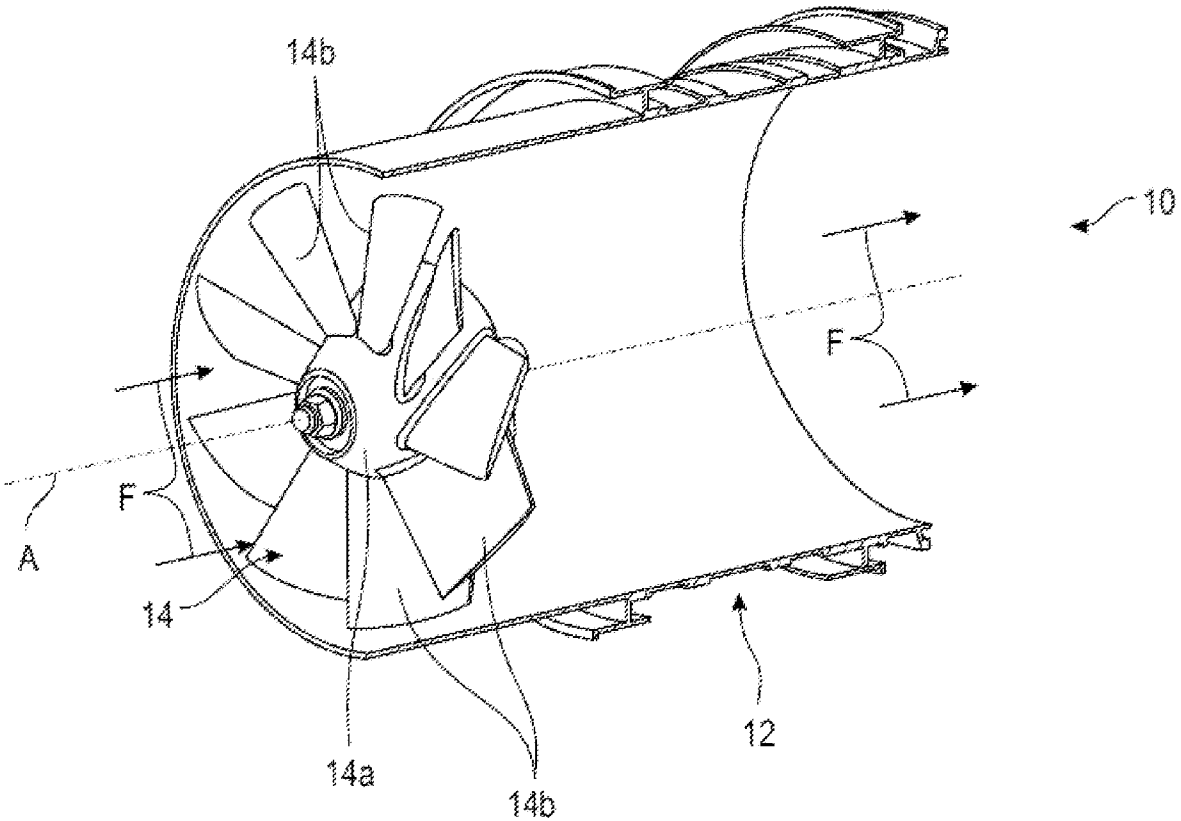
Fig.1 (PRIOR ART)
FIG. 1 is a schematic perspective view and partial cross-section of a device for a fan or a compressor, this device comprising a casing and a bladed wheel.

FIG. 1 has been described in the above.

Figure 2:
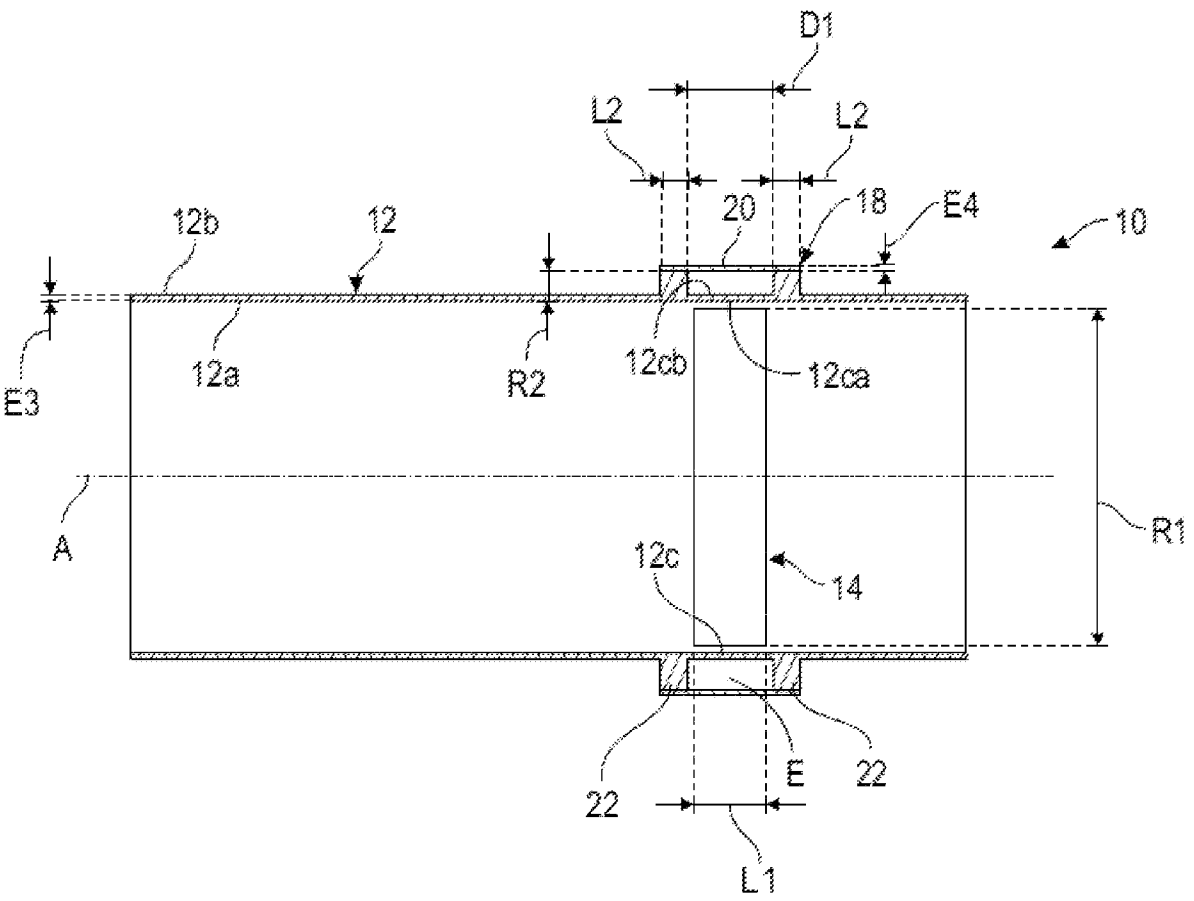
FIG. 2 shows an embodiment of the disclosed subject matter that relates to a device 10 for making a fan or compressor, in particular for the aeronautical industry, said device comprising.
Figure 3:
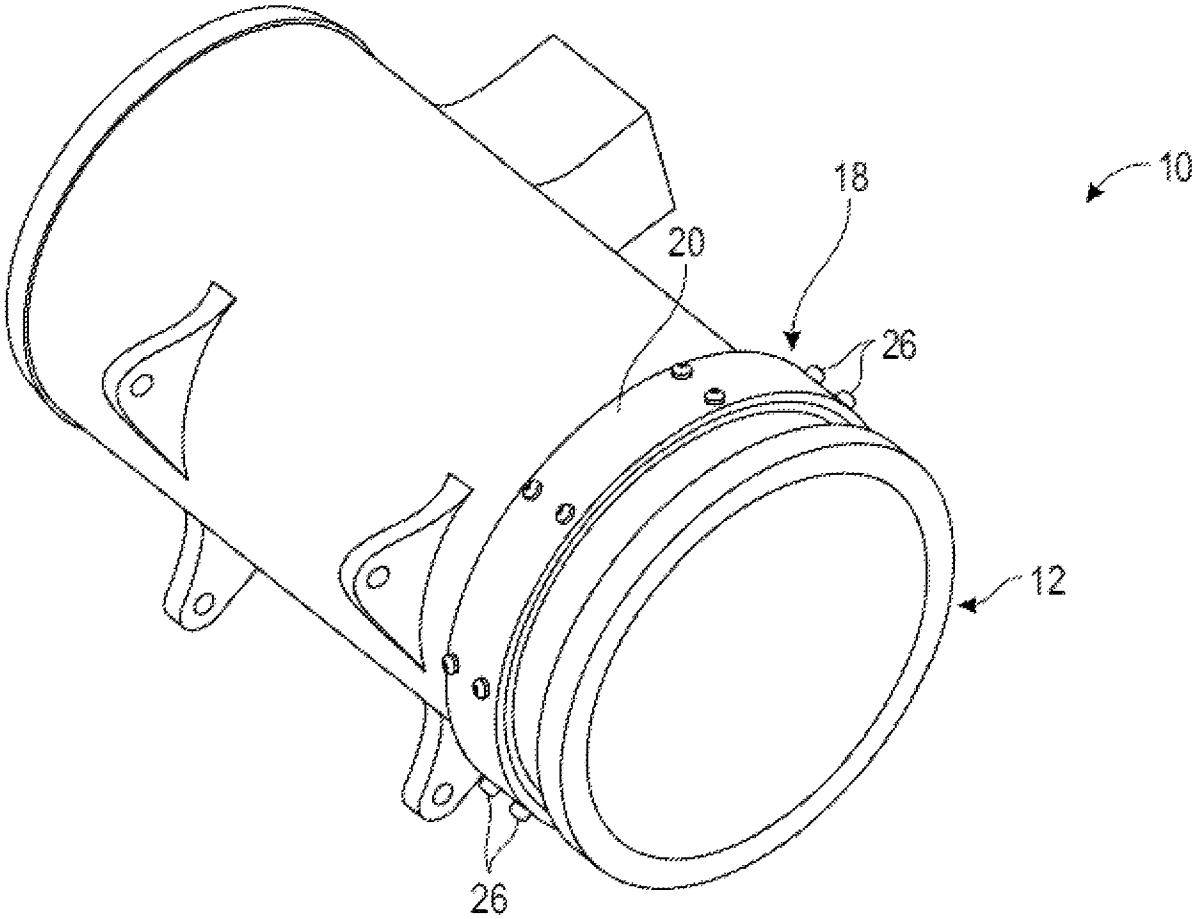
FIG. 3 is a schematic perspective view of a casing and a debris retention system for a device according to the present disclosure.
Figure 4:
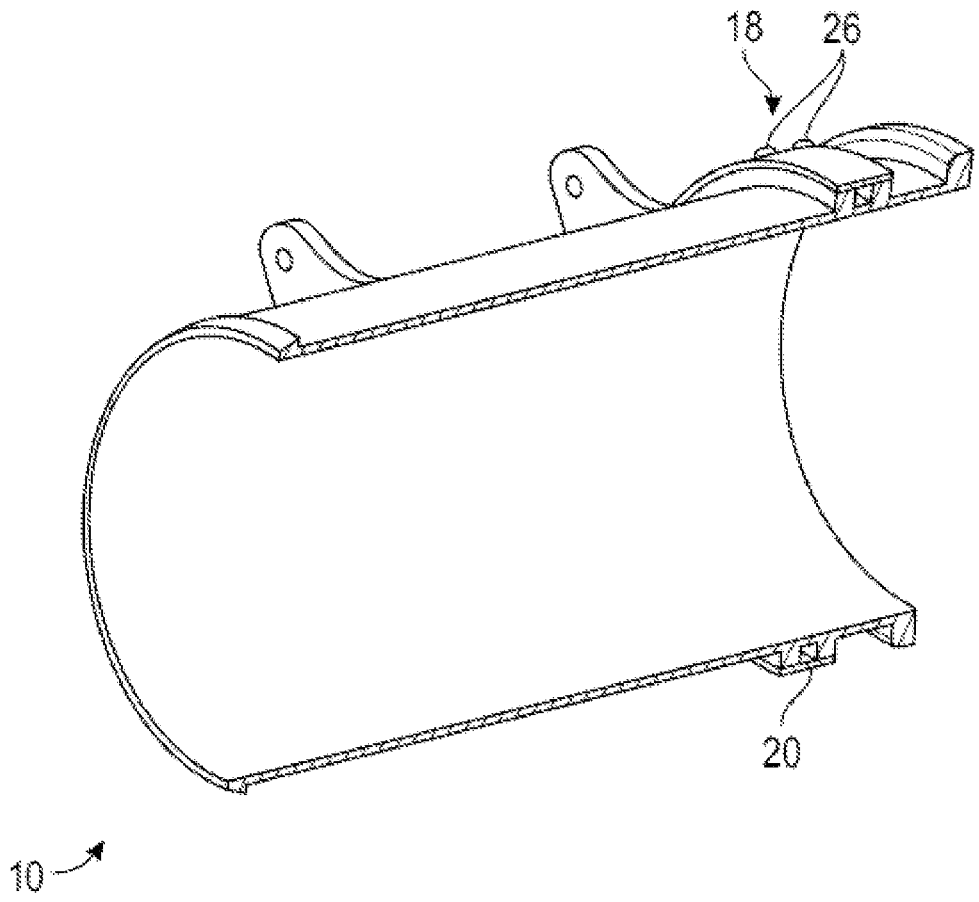
FIG. 4 is a schematic axial cross-section view of the device and the system of FIG. 3.
Figure 5:
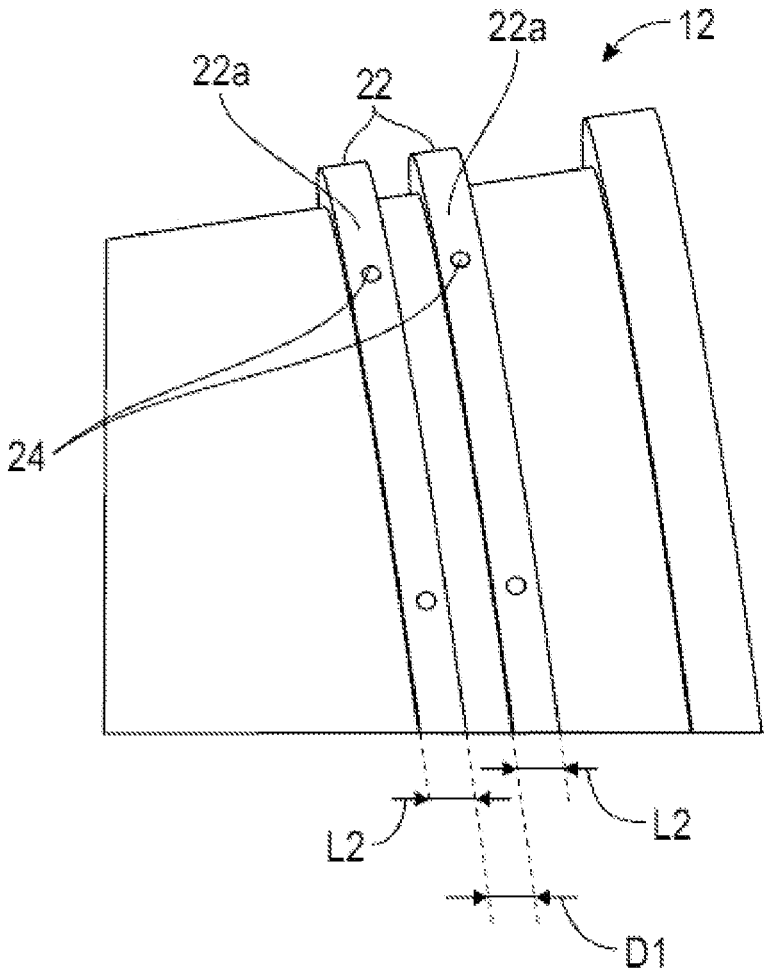
FIG. 5 is a partial perspective drawing of the casing shown in FIG. 2.

FIG. 2 shows an embodiment of the disclosed subject matter that relates to a device 10 for making a fan or compressor, in particular for the aeronautical industry, said device comprising:

- an annular casing 12 comprising a main axis A and defining an internal flow duct for a gas flow along this axis A,
- a bladed wheel 14 mounted inside the casing and having an axis of rotation coinciding with the axis A of the casing 12.

The casing 12 has a generally tubular shape along the axis A. In the example shown, it has a straight shape but could alternatively have a bent shape. The casing 12 comprises an internal annular surface 12*a*, and an external annular surface 12*b*, both of which are cylindrical.

The bladed wheel 14 is very schematically shown in FIG. 2 and is not shown in the following figures. As seen in FIG. 1, this bladed wheel 14 may comprise a hub 14*a* centred on the axis A and blades 14*b* evenly distributed about the axis A and extending radially outward from the external periphery of the hub 14*a*. The bladed wheel 14 is rotatably driven by a shaft that is centred on the axis A and is not shown in the drawings.

The bladed wheel 14 is schematically represented by a rectangle in FIG. 2. This wheel 14 has an axial length or dimension noted L1.

The bladed wheel 14 has an external diameter R1 less than or equal to 1 meter, and preferably less than or equal to 60 centimetres. The application of the device 10 is therefore mainly aimed at relatively small fans and compressors (for the aeronautical industry).

The device 10 according to the present disclosure further comprises a system 18 for retaining debris in the event of breakage of the bladed wheel 14.

This system 18 comprises a retaining annulus 20 that is mounted around the casing 12. For this purpose, the casing 12 comprises two radially outwardly projecting annular bosses 22, in particular on the surface 12*b*, which are located respectively upstream and downstream of the bladed wheel 14. This means that there is a first boss 22 upstream of a transverse plane passing through the upstream end of the bladed wheel 14, for example at the level of leading edges of its blades 14*b*, and a second boss 22 downstream of another transverse plane passing through the downstream end of the bladed wheel 14, for example at the level of trailing edges of its blades 14*b*. This also means that the axial distance D1 between these bosses 22 is greater than the length L1.

Each of these bosses 22 has a general square or rectangular shape in axial cross-section. Each boss 22 has an axial length or dimension L2 and a radial thickness or dimension R2. The two bosses 22 are identical here.

L2 is preferably between 5 and 30% of L1.

Figure 6:
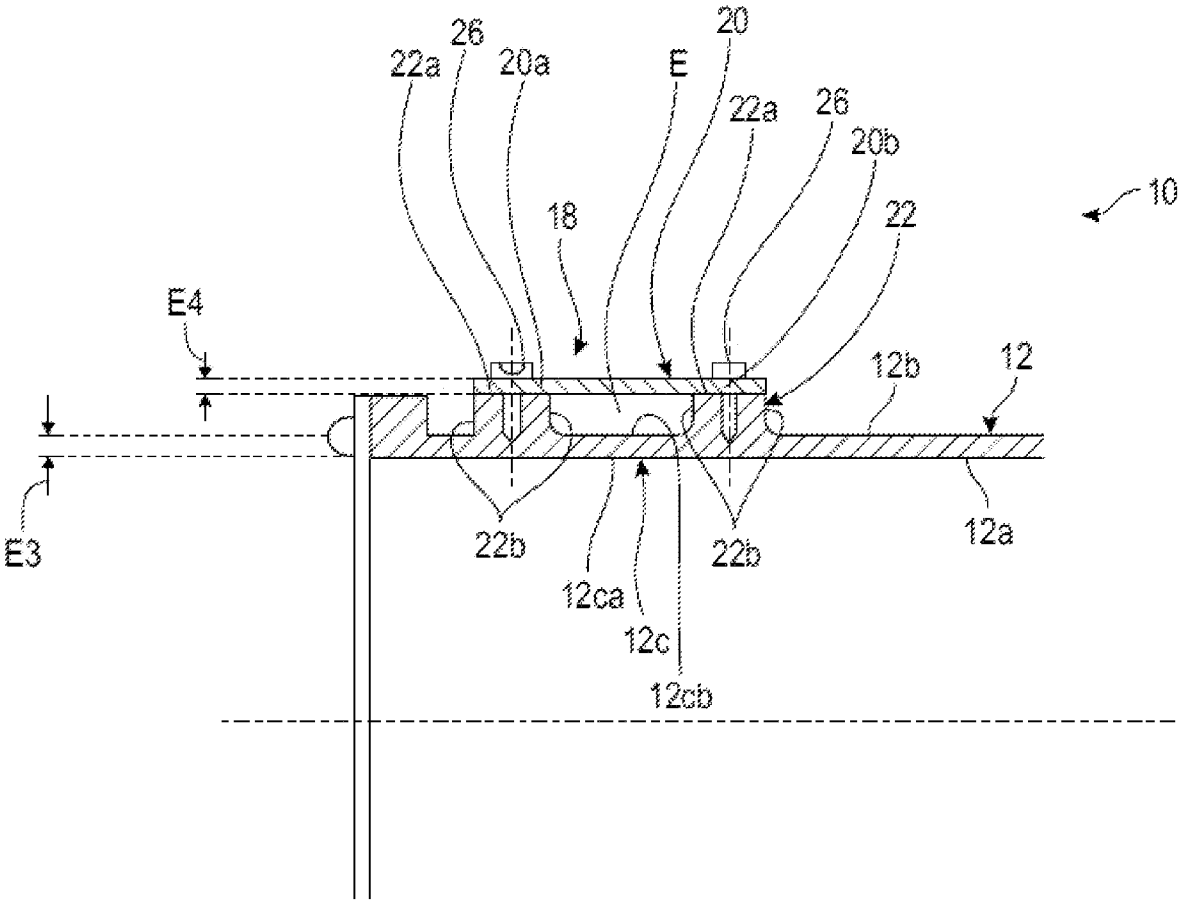
FIG. 6 is a schematic axial cross-sectional view of a device according to the present disclosure.

Each boss 22 comprises an external cylindrical surface 22*a* and radial side surfaces 22*b* (see FIG. 6). The bosses 22 define an annular space E between them, which is empty in the example shown.

The bosses 22 are connected to each other by a tubular wall 12*c* of the casing 12 which has a constant thickness E3 over its entire axial extent. Preferably, the tubular wall 12*a* comprises free and bare internal 12*ca* and external 12*cb* cylindrical surfaces. In other words, this wall 12*c* is devoid of local allowance and in particular of stiffening ribs.

R2 preferably represents between 200% and 1000% of E3.

The retaining annulus 20 extends around the bosses 22 and comprises an upstream edge 20*a* that covers the upstream boss 22 and in particular its surface 22*a*, and is attached to this upstream boss. The annulus 20 comprises a downstream edge 20*b* that covers the downstream boss 22 and in particular its surface 22*a*, and is attached to this downstream boss.

The annulus 20 is generally cylindrical and tubular in shape and may have a constant thickness E4 throughout its axial dimension. This thickness E4 is for example between 1 and 5 mm.

In the examples shown in FIGS. 3 to 6, the upstream 20*a* and downstream 20*b* edges of the annulus 20 comprise orifices that are aligned with threaded holes 24 in the bosses 22 for mounting attachment elements 26, such as screws or rivets.

Alternatively or additionally, the upstream and downstream edges 20*a*, 20*b* of the annulus 20 may be bonded to the bosses 22.

The annulus 20 closes the space E and has the function of retaining debris in case of breakage of the wheel 14, as will be explained in more detail in the following.

The casing 12 is preferably made of metal but could alternatively be made of composite material and for example of filled plastic.

The retaining annulus 20 is preferably made of metal but could alternatively be made of a composite material. In a preferred embodiment of the disclosed subject matter, the annulus 20 is made of austenitic stainless steel, such as 304L or 316L steel. This type of steel has the advantage of a relatively high elongation rate.

Figure 7:
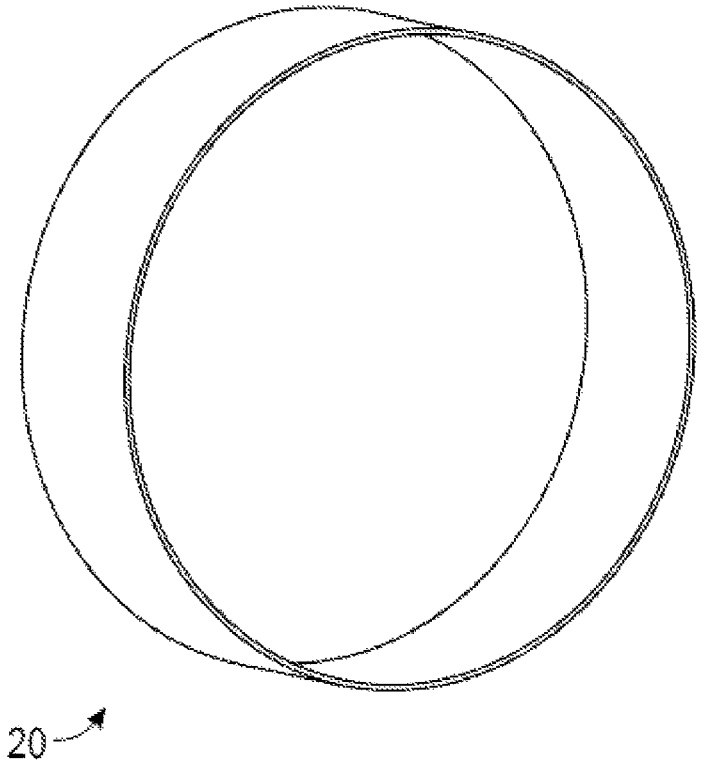
FIG. 7 is a schematic perspective view of a retaining annulus for a device according to the present disclosure.
Figure 8:
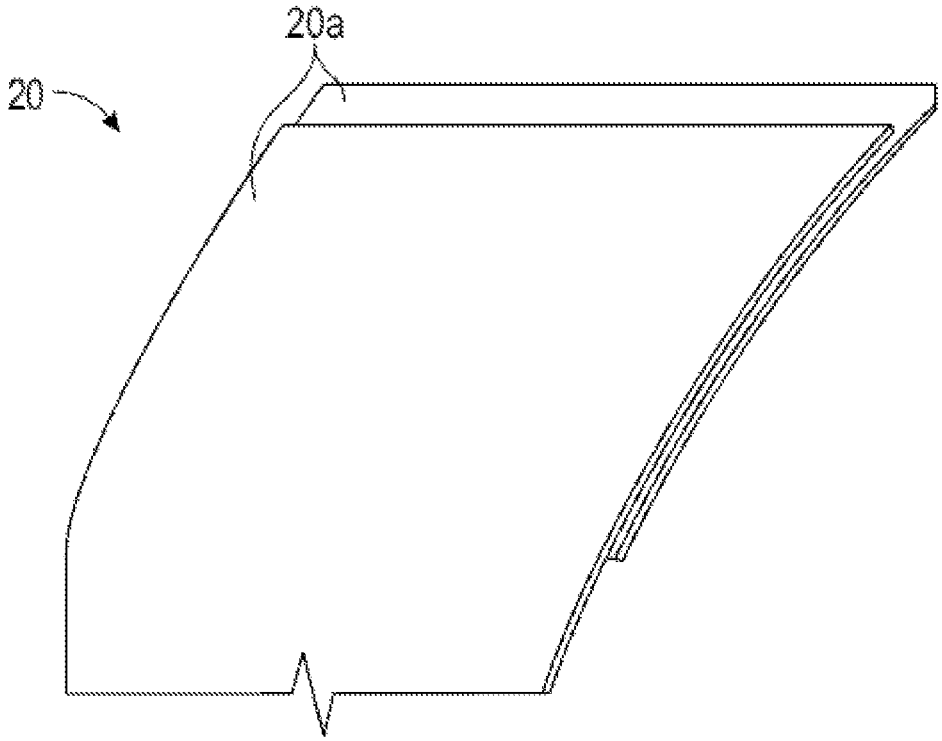
FIG. 8 is a partial schematic perspective view of the annulus in FIG. 7.

As can be seen in FIGS. 7 and 8, the retaining annulus 20 may be continuous through 360° or may be formed by winding a strip of material with overlapping circumferential ends 20*a*. These ends can undergo a dimpling operation.

The debris retention system 18 ensures that debris generated by the breakage of the bladed wheel 14 is prevented from leaving the device 10. In the event of a breakage, the debris from the wheel 14 is likely to pass through the casing 12. The wheel 14 is located between the bosses 22 of the casing, so the debris will pass through the casing between the bosses 22, due to the centrifugal forces applied to the wheel 14 during operation. The bosses 22 attach the retaining annulus 20 around the casing 12, but also serve to channel the debris, after passing through the casing 12, to the retaining annulus 20. The debris will then reach the retaining annulus 20, which has the purpose of blocking the debris and absorbing the energy related to the impact, for example by deforming. The debris is thus not expelled outside the device 10.

The invention claimed is:

1. A fan machine, comprising:

an annular casing comprising a main axis (A) and defining an internal flow duct for a gas flow along the axis;

a bladed wheel mounted inside the annular casing and having an axis of rotation coincident with the axis (A) of the annular casing; and a system configured to retain debris in an event of breakage of the bladed wheel, this system comprising a retaining annulus, the retaining annulus being mounted around the annular casing and comprising upstream and downstream annular edges, the annular casing comprising two radially outwardly projecting annular bosses which are located respectively upstream and downstream of the bladed wheel, wherein each of the two radially outwardly projecting annular bosses comprises an external cylindrical surface on top of which the upstream and downstream annular edges of the retaining annulus are respectively applied and attached in such a manner that the bosses, the retaining annulus and a portion of the annular casing parallel to the retaining annulus form a covered annular space, wherein the upstream and downstream edges of the retaining annulus comprise orifices that are aligned with threaded holes of the two radially outwardly projecting annular bosses.

2. The fan machine of claim 1, wherein the annular casing comprises, between the two bosses and around the bladed wheel, a tubular wall having a constant radial thickness (E3).

3. The fan machine of claim 2, wherein the tubular wall comprises free and bare internal and external cylindrical surfaces.

4. The fan machine according to claim 1, wherein the annular casing is made of metal or composite material, and/or the retaining annulus is made of metal or composite material.

5. The fan machine of claim 1, wherein the upstream and downstream edges of the retaining annulus are further bonded to the bosses.

6. The fan machine of claim 1, wherein the retaining annulus is continuous through 360° or is formed by winding a strip of material with overlapping circumferential ends.

7. The fan machine of claim 1, wherein the bladed wheel has an external diameter of less than or equal to 1 meter.

8. The fan machine of claim 1, wherein the bosses each have an axial dimension (L2) representing between 5 and 30% of a maximum axial dimension (L1) of the bladed wheel.

9. The fan machine of claim 1, wherein the bosses each have a radial dimension (R2) of between 200% and 1000% of a radial thickness (E3) of the annular casing between the bosses.

10. The fan machine of claim 1, wherein the retaining annulus has a radial thickness between 1 and 5 mm.

11. The fan machine of claim 1, wherein said orifices are radial orifices and said threaded holes are radial threaded holes.

12. A fan machine, comprising:

an annular casing comprising a main axis (A) and defining an internal flow duct for a gas flow along this axis;

a bladed wheel mounted inside the annular casing and having an axis of rotation coincident with the axis (A) of the annular casing; and a system configured to retain debris in an event of breakage of the bladed wheel, this system comprising a retaining annulus, the retaining annulus being mounted around the annular casing and comprising upstream and downstream annular edges, the annular casing comprising two radially outwardly projecting annular bosses which are located respectively upstream and downstream of the bladed wheel, wherein the upstream and downstream annular edges of the retaining annulus are applied and attached respectively to said two radially outwardly projecting annular bosses, wherein the upstream and downstream edges of the retaining annulus comprise orifices that are aligned with threaded holes of the two radially outwardly projecting annular bosses, wherein the two radially outwardly projecting annular bosses comprise opposite inner walls configured to channel the debris passing through the casing to the retaining annulus.

* * * * *